United States Patent [19]

Olson

[11] 4,375,942

[45] Mar. 8, 1983

[54] TILTING CAM, ROTATING BARREL PUMP

[75] Inventor: John R. Olson, Oconomowoc, Wis.

[73] Assignee: Dynes/Rivett Inc., Pewaukee, Wis.

[21] Appl. No.: 256,222

[22] Filed: Apr. 21, 1981

[51] Int. Cl.[3] ..... F04B 1/30; F15B 9/10; F15B 13/16

[52] U.S. Cl. ..... 417/222; 91/367; 91/374; 91/382; 91/459

[58] Field of Search ..... 417/218-222; 60/445, 452; 91/367, 368, 374, 382, 385, 417, 459

[56] References Cited

U.S. PATENT DOCUMENTS

| | | | |
|---|---|---|---|
| 3,406,850 | 10/1968 | Hancox | 417/218 |
| 3,875,849 | 4/1975 | Patel . | |
| 4,011,891 | 3/1977 | Knutson et al. | 91/382 X |
| 4,227,441 | 10/1980 | Prochazka et al. | 91/382 X |
| 4,273,517 | 6/1981 | Heyl | 417/222 |

FOREIGN PATENT DOCUMENTS

| | | | |
|---|---|---|---|
| 2930106 | 2/1981 | Fed. Rep. of Germany | 417/218 |

*Primary Examiner*—Edward K. Look
*Attorney, Agent, or Firm*—John J. Byrne

[57] ABSTRACT

Disclosed is a pump comprising a rotatable barrel, a tiltable pump cam, and a proportional servo actuator operatively connected to the pump cam to affect the angle between the pump cam and the axis of the barrel.

66 Claims, 7 Drawing Figures

FIG. 2
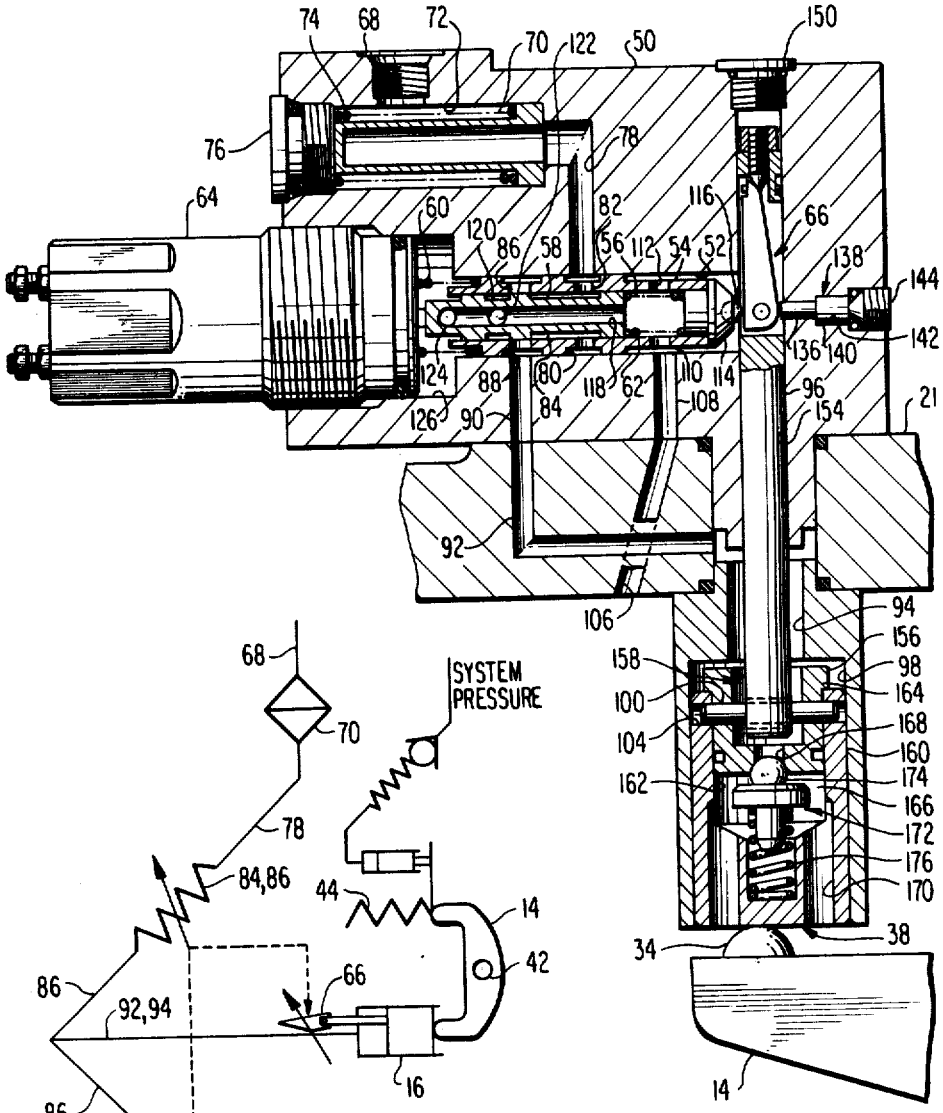
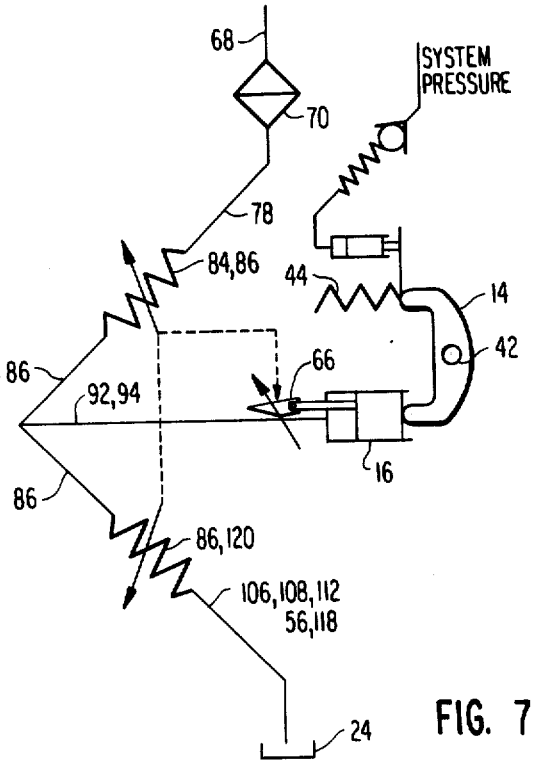
FIG. 7

TILTING CAM, ROTATING BARREL PUMP

TECHNICAL FIELD

This invention relates to tilting cam, rotating barrel pumps. More specifically, it relates to an improved means for affecting the angle between the pump cam and the axis of the barrel of such a pump.

BACKGROUND OF THE PRIOR ART

Tilting cam, rotating barrel pumps are known per se. Such pumps comprise a rotatable barrel containing pumping pistons, a tiltable pump cam operatively connected to the pumping pistons, and a proportional servo actuator operatively connected to the pump cam. The pump cam is connected to the barrel such that, when the pump cam is perpendicular to the axis of the barrel, the pumping pistons are not displaced axially and no fluid is pumped, and the more the pump cam is tilted relative to the axis of the barrel, the more the pumping pistons are displaced axially and the more fluid is pumped. The proportional servo actuator includes an output member which bears against the pump cam in a direction parallel to the axis of the barrel. As the output member is translated backward and forward, the pump cam is caused to tilt relative to the barrel.

BRIEF SUMMARY OF INVENTION

The invention relates particularly to an improved means for affecting the angle between the pump cam and the axis of the barrel of the pump.

In one aspect, the invention relates to a spool-in-sleeve proportional servo actuator in which the motion of the sleeve relative to a given change in the tilt of the pump cam can be adjusted by means comprising (a) a control cam which has a cam surface positioned to contact the sleeve and is mounted for pivotal movement about an axis perpendicular to the direction of motion of the sleeve, (b) means for biasing the control cam in a first angular direction about its axis, and (c) means for moving the control cam in the opposite direction about its axis, thereby changing the angle of the control cam surface relative to its axis.

In a second aspect, the invention relates to a spool-in-sleeve proportional servo actuator operatively connected to an output member including a piston which has a through-bore containing a relief valve, thereby permitting control pressure to be vented to tank through the through-bore when its exceeds a preset value.

BRIEF DESCRIPTION OF THE DRAWINGS

FIG. 2 is a sectional view along the line 2—2 in FIG. 1.

FIG. 7 is a schematic drawing of the electro-hydraulic control circuitry for the pump shown in FIG. 1.

DETAILED DESCRIPTION OF THE PRESENTLY PREFERRED EMBODIMENT

Figure 1:
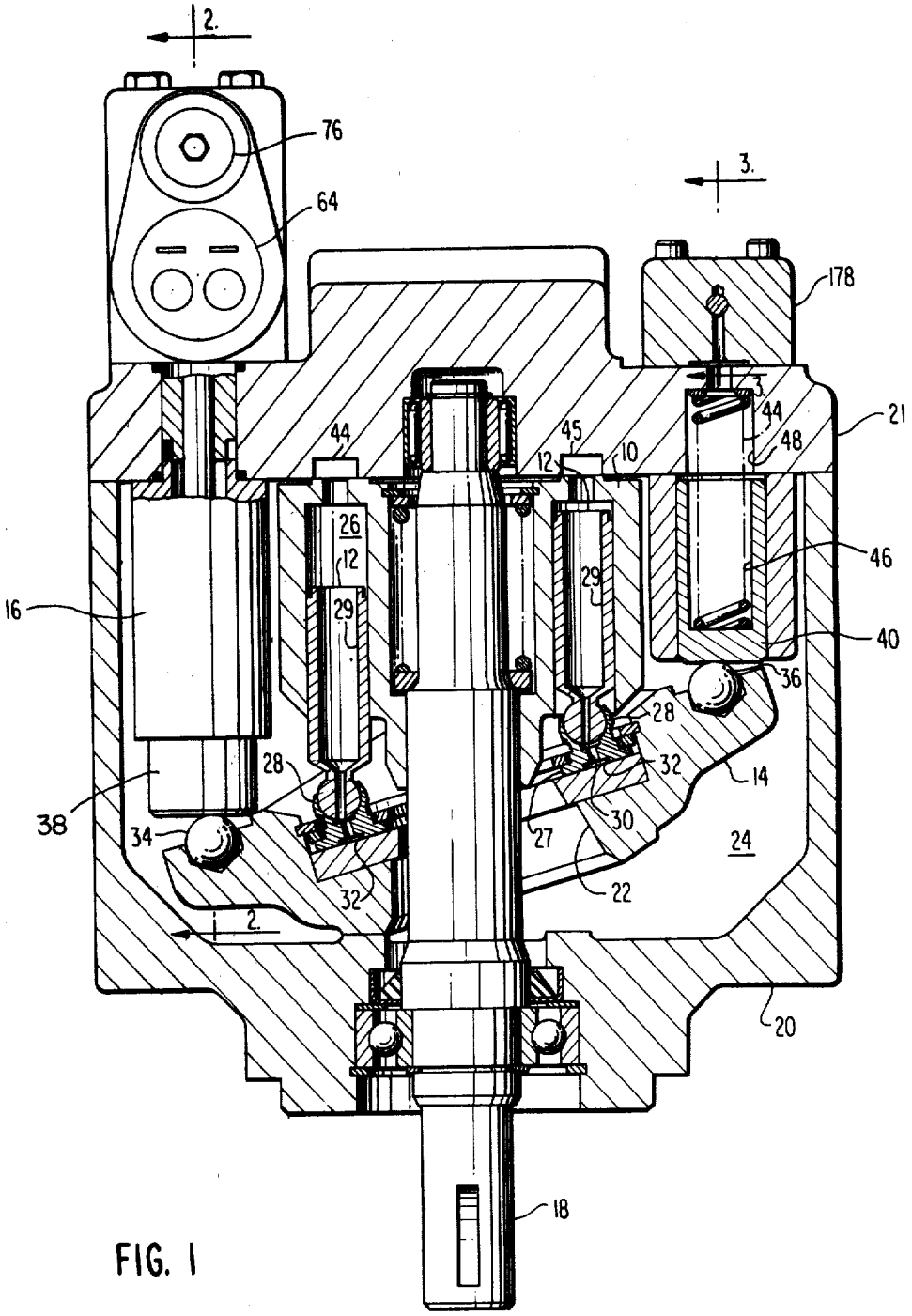
FIG. 1 is a cross-sectional view of a pump according to this invention.

With particular reference to FIG. 1, the presently preferred embodiment comprises a rotatable barrel 10 containing pumping pistons 12, a titable pump cam 14 operatively connected to the pumping pistons 12, and a proportional servo actuator 16 which contacts the tiltable pump cam 14 to affect the angle between the tiltable pump cam 14 and the axis of the rotatable barrel 10. Although two diametrically opposite pumping pistons 12 are shown in FIG. 1, in practice it has been found desirable to use nine equally spaced pumping pistons, which means that no two pumping pistons are actually diametrically opposite each other. The rotatable barrel 10 is mounted on shaft 18 which is journaled at one end in a housing 20 and at the other end in a cover 21. The shaft 18 passes through a clearance hole 22 in the tiltable pump cam 14. The tiltable pump cam 14 is located in a chamber 24 in the housing 20. The chamber 24 acts as a tank for the hydraulic circuitry to be described.

The pumping pistons 12 are slidably received in pumping chambers 26 in the rotatable barrel 10. The pumping pistons 12 are connected to sliding shoes 27 via universal joints 28. Through passages 29 and 30 in the pumping pistons 12 and the sliding shoes 27, respectively, communicate system pressure during the pumping strokes to enclosed volumes 32 between the sliding shoes 27 and the tiltable pump cam 14, thereby reducing friction between the sliding shoes 27 and the tiltable pump cam 14.

Two diametrically opposed balls 34 and 36 are captured in the periphery of the tiltable pump cam 14, where they ride on pistons 38 and 40, respectively. The tiltable pump cam 14 tilts on two trunion bearings 42 (shown only in FIG. 7).

As the shaft 18 is rotated by a primer mover (not shown), it causes the barrel 10 to rotate. As the barrel 10 rotates, the pumping chambers 26 come into register alternately with arcuate-shaped inlet and outlet slots 44 and 45. When the tiltable pump cam 14 is perpendicular to the axis of the rotatable barrel 10, the pumping pistons 12 are not displaced axially and no fluid is pumped. However, the more the pump cam 14 is tilted relative to the axis of the rotatable barrel 10, the more the pumping pistons 12 are displaced axially and the more fluid is pumped.

Since all of the foregoing is typical of prior art tilting cam, rotating barrel pumps, it will not be described further.

In the illustrated pump, the piston 40 is biased outwardly by coil spring 44 one end of which is received in a blind bore 46 in the piston 40 and the other end of which is received in a chamber 48 in the cover 21. The coil spring 44 in linear, thereby providing a force which biases the piston 40 against the ball 36 the value of which changes by a constant amount per length-unit of displacement of the piston 40. The piston 38 is biased outwardly by means of the proportional servo actuator 16, which will now be described with reference to FIG. 2.

The proportional servo actuator 16 is somehwat similar to the proportional servo actuator disclosed in commonly assigned U.S. Pat. No. 3,875,849, issued Apr. 8, 1975, to Kishor J. Patel, and reference to that patent may be had for background.

The proportional servo actuator 16 comprises a body 50 containing a first bore 52, a sleeve 54 slidably positioned in the first bore 52, a second bore 56 in the sleeve 54, a spool 58 slidably positioned in the second bore 56, first means 60 comprising a coil spring biasing the sleeve 54 to the right in FIG. 2, second means 62 comprising a coil spring biasinng the spool 58 to the left in FIG. 2, third means 64 comprising an electrical force motor for moving the spool 58 to the right in FIG. 2 against the bias of the second means 62, and fourth means 66 for moving the sleeve 54 to the left in FIG. 2 against the bias of the first means 60.

Hydraulic fluid at supply pressure (for instance, 250 p.s.i.) enters the body 50 at port 68 and passes through a filter 70 in chamber 72. The filter 72 is biased towards the right in FIG. 2 by coil spring 74, and a threaded access plug 76 is provided for replacing the filter 70 without having to disconnect the supply pressure.

From the chamber 72 hydraulic fluid is transmitted to the bore 52 via passageway 78. An annular relief 80 in the sleeve 54 is in registry with the outlet of the passageway 78 over the entire range of movement of the sleeve 54. Radial bores 82 in the sleeve 54 communicate the hydraulic fluid at supply pressure to an annular relief 84 in the spool 58. The annular relief 84 is in restricted communication with radial bores 86 when the spool 58 is moved sufficiently far to the left in FIG. 2 relative to the sleeve 54. The opening between the annular relief 84 and the radial bores 86 serves as a restricted orifice which steps the supply pressure down to control pressure (for instance, 100 p.s.i.). The exact amount by which the supply pressure is stepped down is, of course, a function of the relative positions of the sleeve 54 and the spool 58, allowing the control pressure to vary to match (or to cause) variations in the force exerted on the ball 36 by the coil spring 44 and other unbalanced pumping forces.

When the spool 58 is moved to the left relative to the sleeve 54 from the position shown in FIG. 2 hydraulic fluid at control pressure flows from the radial bores 86 to an annular relief 88 in the sleeve 54. The annular relief 88 is in registry with a passageway 90 in the body 50 over the entire range of movement of the sleeve 54. The passageway 90 in the body 50 is in fluid communication with a passageway 92 in the cover 21. The passageway 92 opens into a bore 94 into which a feedback rod 96 extends. The bore 94 in turn opens into a fourth bore 98 in which the piston 38 is slidingly received. The piston 38 is operatively connected to the feedback rod 96 by a pin 100 which passes through a radial clearance hole 102 in the feedback rod 96 and extends into radial holes 104 in the piston 38. Thus, control pressure in the fourth bore 98 bearing against the upper face of the piston 38 affects the axial position of the feedback rod 96.

As previously mentioned, the chamber 24 in the housing 20 acts as a tank (i.e., it contains hydraulic fluid at 0 p.s.i.). Hydraulic fluid at tank pressure enters a passageway 106 in the cover 21 which is in fluid communication with a passageway 108 in the body 50. The passageway 108 leads to the first bore 52 at an annular relief 110 on the sleeve 54 which is in communication with the passageway 108 over the entire range of movement of the sleeve 54. The annular relief 110 communicates with radial bores 112 which extend through the sleeve 54 to the second bore 56. The second bore 56 is closed at the right in FIG. 2 by a press-fit plug 114 in which is mounted a ball 116. The annular relief 110 extends to the right end of the sleeve 54, so the ball 116 is bathed in tank pressure.

The spool 58 contains a blind axial bore 118 which opens into the second bore 56, and hydraulic fluid at tank pressure from the second bore 56 enters the blind bore 118. An annular relief 120 is provided in the sleeve 58 just to the left of the radial bores 86 in the sleeve 54, and radial bores 122 (only one of which is shown) communicate the annular relief 120 to the blind axial bore 118. Accordingly, when the spool 58 if moved to the right in FIG. 2 relative to the sleeve 54, hydraulic fluid at control pressure in the fourth bore 98 is vented to tank through the bore 94, the passageway 92, the passageway 90, the annular relief 88, the radial bores 86, the annular relief 120, and radial bores 122.

The spool 58 also contains radial bores 124 (only one of which is shown) leading from the blind axial bore 118 to a chamber 126 in the body 50. The sleeve 54 and the spool 58 both extend into the chamber 126 from one direction, and the third means 64 extends into the chamber 126 from the other direction. Thus, the interface between the third means 64 and the spool 58 is bathed in tank pressure. It will also be noted that the first means 60 and the second means 62 are both bathed in tank pressure and that both ends of the sleeve-and-spool combination 54, 58 are bathed in tank pressure. Thus, movement of the sleeve-and-spool combination 54, 58 is governed entirely by the first means 60, the second means 62, the third means 64, and the fourth means 66.

Figure 4:
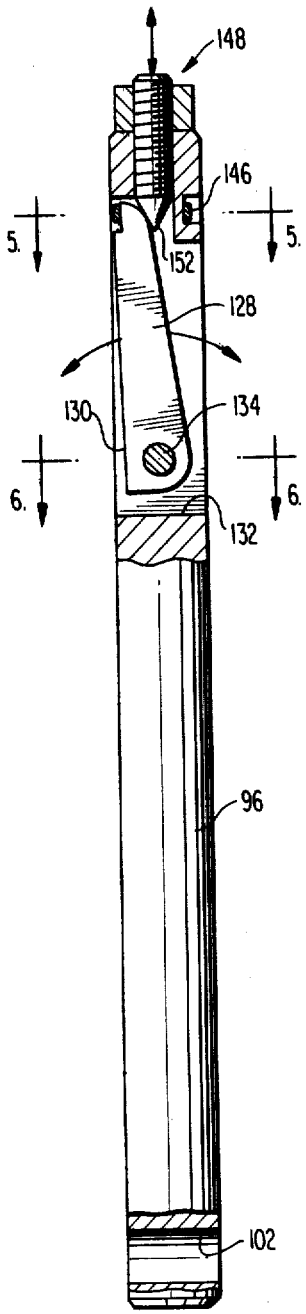
FIG. 4 is a view on an enlarged scale of a fragment of FIG. 2.
Figure 5:
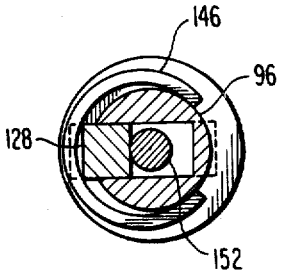
FIG. 5 is a sectional view along the line 5—5 in FIG. 4.
Figure 6:
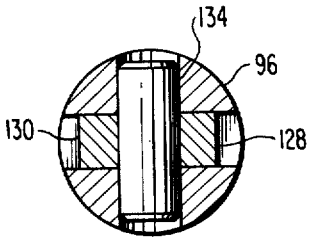
FIG. 6 is a sectional view along the line 6—6 in FIG. 4.

Turning now to FIGS. 4–6, the fourth means 66 will be described. It comprises a control cam 128 which has a cam surface 130 which is positioned to contact the ball 116 mounted in the plug 114 in the sleeve 54. The control cam 128 is mounted in a through slot 132 in the feedback rod 96 for pivotal movement about a stub shaft 134 slip fit in the feedback rod 96 perpendicularly to the direction of motion of sleeve 54. The through slot 132 is in communication with the first bore 52 adjacent the ball 116, so the control cam 128 is bathed in tank pressure. A smaller diameter portion of a stepped pin 138 protrudes into the through slot 132 to prevent rotation of the feedback rod 96. The larger diameter portion 40 of the stepped pin 138 seats in a stepped bore 142 in the body 50 at a point which prevents contact between the portion 136 and the control cam 128. A set screw 144 holds the stepped pin 138 firmly in position in the stepped bore 142.

The fourth means 66 also comprises fifth means 146 in the form of a spring clip biasing the control cam 128 in the clockwise direction in FIG. 4 about the stub shaft 134 and sixth means 148 in the form of a set screw threadedly received in the feedback rod 96 for pivoting the control cam 128 about the stub shaft 134. A threaded access plug 150 gives access to the set screw 148. Ordinarily, the position of the set screw 148 is adjusted only at the factory.

As will be apparent, operation of the set screw 148 causes minute changes in the movement of sleeve 54 except in the null position. Rotation of the set screw 148 by a few turns causes relatively slight axial movement of the conical point 152 of the set screw 148. Axial movement of the conical point 152 of the set screw 148 in turn causes a relatively slight pivoting of the control cam 128 due to (1) the low ratio of the length of the axial movement of the set screw 148 to the distance between the axis of the stub shaft 134 and the point of contact between the control cam 128 and the set screw 148 and (2) the fact that the conical point 152 of the set screw 148 contacts the control cam 128 at an angle. Finally, pivotal movement of the control cam 128 causes relatively slight axial movement of the sleeve 54 (except in the null position) because the cam surface 130 is almost perpendicular to the ball 116. Thus, there are four separate step-down devices between rotational motion of the set screw 148 and axial motion of the sleeve 54. Accordingly, the position of sleeve 54 can be adjusted with an extraordinary degree of precision.

Returning to FIG. 2, it will be seen that the feedback rod 92 is slidingly received in a third bore 154 which is perpendicular both to the axis of the stub shaft 134 and the direction of motion of the sleeve 54. Thus, since the feedback rod 96 is operatively connected to the piston 38 and since the ball 34 rides on the piston 38 in the manner previously explained, translational movement of the piston 38 causes corresponding translational movement of the control cam 128 and tilting motion of pump cam 14. The control cam 128 is pivotably positioned such that translational movement of the control cam 128 causes the sleeve 54 to move in the first bore 52 in a fashion which is dependent on the angle of the control cam 128. That way, the set screw 148 can be used to adjust the relationship of the motion of the sleeve 54 relative to the tilting motion of the pump cam 14.

The piston 38 is preferably fabricated in two parts. An inner part 156 contains a blind axial bore 158 into which the feedback rod 96 projects. An outer part 160 having a blind bore 162 is slip fit over the inner part 156 until it bottoms on an annular abuttment 164 on the inner part 156, leaving a chamber 166 between the inner part 156 and the outer part 160. An axial bore 168 provides communication between the axial bore 158 and the chamber 166, and a plurality of bores 170 provide communication between the chamber 166 and the chamber 24. The axial bores 158, and 168, the chamber 166, and the bores 170 together constitute a fifth bore leading through the piston 38. A relief valve 172 comprising a ball valve 174 which valves the axial bore 158 and means 176 biasing the ball valve 174 closed is provided in the fifth bore. Accordingly, hydraulic fluid at control pressure from the bore 94 is vented through the fifth bore to tank when it exceeds a preset value.

In use, when it is desired to begin delivery of the fluid being pumped, a voltage is applied to the force motor 64. The force motor 64 and the second means 62 shift the spool 58 to the left in FIG. 2. The spool 58 is part of a valve that supplies control fluid to fourth bore 98, where it acts on piston 38. The piston 38 pushes downwardly on one side of the tiltable pump cam (or pump cradle, as it is sometimes called) 14. This causes the pump cam 14 to pivot about the trunnion bearings 42 (shown only in FIG. 7). This in turn causes the pump cam 14 to tilt in the counter-clockwise direction in FIG. 1. Accordingly, fluid begins to be pumped at a rate which is a function of the voltage applied to the force motor 64.

If the voltage to the force motor 64 is then reduced, the reverse action takes place. That is, the spool 58 shifts to the right in FIG. 2, control fluid is drained from the fourth bore 98, the piston 38 moves upwardly under the urgings of the spring 44 acting against the piston 40 on the other side of the tiltable pump cam 14, and pump delivery decreases or stops, depending on the amount by which the voltage has been reduced.

In this way, voltage to the force motor 64 can be used to control delivery from the pump. It should be particularly noted that, for each valve of voltage, there is a unique corresponding pump delivery (assuming, of course, that the shaft 18 is rotated at a constant angular velocity).

The operation of the control cam 128 is as follows. The piston 38 contacts the ball 34 and supplies a counter-force to the spring 44 to control the tilt of the pump cam 14. The piston 38 also moves the feedback rod 96 and the control cam 128. That is, the tiltable pump cam 14, the piston, 38, the feedback rod 96, and the control cam 128 all move together. In the presently preferred embodiment, as the pump cam 14 tilts from 0 to full stroke (shown in FIG. 1), the piston 38, the feedback rod 96, and the control cam 128 all move approximately 0.840" along the axis of the feedback rod 96. When the feedback rod 96 moves axially, the resulting motion of the sleeve 54 depends on the angle of the control cam 128. for example, if the control cam angle is 0 (that is, if the cam surface 130 is parallel to the axis of the feedback rod 96), no motion of the sleeve 54 results. If the angle of the control cam 128 is other than 0, the sleeve 54 will move axially in direct proportion to the tangent of the angle of the control cam 128.

The pump and control can be nulled as follows. With 0 voltage to force motor 64, supply pressure (approximately 250 p.s.i.) is applied to port 68. With the pump running, force motor 64 is adjusted in or out by rotating it clockwise or counter-clockwise respectively. When pump delivery has decreased to 0 flow, the pump and control are at null. The force motor is then locked in the null position by a set screw (not shown).

When the tiltable pump cam 14 is at 0 cam angle (and the pump is at 0 flow), the axis of the stub shaft 134 intersects the projected axis of the sleeve-and-spool combination 54, 58, and the ball 116 contacts the control cam 128 at a point on the projected axis of the sleeve-and-spool combination 54, 58. Since the pump and control are nulled when the axes of the stub shaft 134 and the sleeve-and-spool combination 54, 58 intersect, it is possible to adjust (i.e., pivot) the control cam 128 without affecting the null setting.

Adjusting the angle of control cam 128 relative to the axis of the feedback rod 96 adjusts the relationship of input voltage to the force motor 64 relative to output flow from the pump. This feature is beneficial for several reasons:

1. Manufacturing tolerances in the force motor 64 and other control parts will result in inconsistent relationships between input voltage to the force motor relative to output flow from the pump. This feature allows the pumps with this control to be adjusted to be consistent. Typically this adjustment is made during final production test.

2. If full flow from the pump is desired at reduced voltage, this can be provided by means of this adjustment.

3. If reduced flow is desired at full voltage, this also can be provided with this adjustment.

When a voltage is applied to the force motor 64, the spool 58 moves to the left in FIG. 2. As previously explained, this causes the pump cam 14 to tilt. The feedback rod 96 and the control cam 128 also move with the piston 38. This motion continues until control cam 128 has shifted sleeve 54 back to the position relative to spool 58 shown in FIG. 2. In this position, hydraulic control fluid is no longer flowing to bore 94, and the axial motion of the piston 38 ceases. Thus, if, for instance, it is desired to have full delivery of the pump at 10 volts to the force motor 64, one applies 10 volts to the force motor 64 and adjusts the set screw 148 until the pump delivery is set at full.

Figure 3:
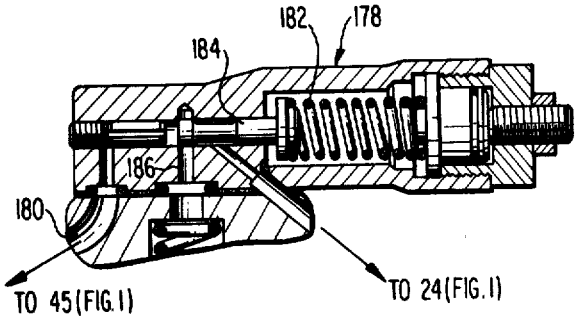
FIG. 3 is a sectional view along the line 3—3 in FIG. 1.

Pressure compensator control 178 functions when system pressure (pressure caused by a load in the hydraulic system) exceeds a pre-set value. See FIG. 3. The pressure compensator control 178 receives system pressure from the arcuate shaped outlet slot 45 via a passageway 180. The pressure compensator control 178 comprises a spring 182 which biases a spool 184 towards a position in which it blocks a passageway 186 leading to the chamber 48. When the force caused by system pressure acting on spool 184 exceeds the setting of the spring 182, the spool 184 opens, permitting fluid at system pressure to enter the chamber 48 and the blind bore 46. The system pressure in the blind bore 46 in turn supplements the force of the spring 44 against the piston 40, causing the tiltable pump cam 14 to pivot clockwise in FIG. 1, destroking the pump. As a result, pressure in fourth bore 98 increases. When this pressure exceeds the setting of relief valve 172, fluid oil in fourth bore 98 is by-passed through bore 168 in piston 38. In this way pressure acting on piston 40 can override the pressure in fourth bore 98 acting on piston 38 and can cause the pump to go toward decreasing stroke.

A relief valve in a hydraulic system limits the pressure in that system by by-passing fluid above a pre-set value to tank. This wastes energy and heats up the hydraulic system. In contrast, pressure compensator control 178 destrokes the pump when the pre-set maximum system pressure has been reached. The pump then delivers just enough fluid to maintain this pressure. In this way energy is not wasted, and the hydraulic system does not heat up excessively.

Of course, the relief valve 172 is designed to open at a pressure that is above the pressures required to operate the piston 38 under normal conditions. In this way, the servo normally operates independently of the relief valve 172, selecting a pump delivery dictated only by the voltage to the force motor 64. The pressure compensator control 178 only overrides this control when system pressure exceeds the pressure setting of the pressure compensator control 178 due to emergency or other unforseen circumstances.

The adjustability of the control cam 128 does several things. First, manufacturing tolerances in the force motor 64 and the control cam 128 (if it were fixed) would result in over- or under-stroking the pump. With the adjustable control cam 128, the output of the force motor 64 can be adjusted to the pump stroke. Second, if a user of the pump wishes to use a lower voltage than standard, he can still obtain full pump stroke by adjusting the control cam 128. And third, if a user of the pump wishes to use a reduced stroke for a given voltage, he can also do that by adjusting the control cam 128.

Caveat

While the present invention has been illustrated by a detailed description of a preferred embodiment thereof, it will be obvious to those skilled in the art that various changes in form and detail can be made therein without departing from the true scope of the invention. For that reason, the invention must be measured by the claims appended hereto and not by the foregoing preferred embodiment.

I claim:

1. A proportional servo actuator comprising:

(a) a body containing a first bore;

(b) a sleeve containing a second bore slidably positioned in said first bore;

(c) a spool slidably positioned in said second bore;

(d) first means for biasing said sleeve in a first direction in said first bore;

(e) second means for biasing said spool in a second direction, opposite to the first direction, in said second bore;

(f) third means for moving said spool in the first direction against the bias of said second means; and (g) fourth means for moving said sleeve in the second direction against the bias of said first means, said fourth means comprising:

(i) a control cam which (A) has a cam surface positioned to contact said sleeve and (B) is mounted for pivotal movement about a pivotal axis perpendicular to the direction of motion of said sleeve;

(ii) fifth means for biasing said control cam in a first angular direction about its pivotal axis; and (iii) sixth means for moving said control cam in a second angular direction, opposite to said first angular direction, about its pivotal axis, whereby operation of said sixth means adjusts the motion of said sleeve in said first bore.

2. A proportional servo actuator as recited in claim 1 wherein:

(a) said control cam is mounted for translational movement in the direction perpendicular both to its pivotal axis and the direction of motion of said sleeve and (b) the cam surface on said control cam is positioned such that (i) translational movement of said control cam causes said sleeve to move in said first bore in a manner which is dependent on the angle of said control cam and (ii) angular adjustment of said control cam changes the relationship between the translational movement of said control cam and the motion of said sleeve.

3. A proportional servo actuator as recited in claim 2 wherein:

(a) the proportional servo actuator further comprises a rod slidably received in a third bore;

(b) said control cam is pivotably mounted on said rod; and (c) the position of said rod in said third bore is a function of the position of said spool in said sleeve.

4. A proportional servo actuator as recited in claim 3 wherein said sixth means is mounted on said rod.

5. A proportional servo actuator as recited in claim 4 wherein said sixth means is a set screw threadedly received in said rod.

6. A proportional servo actuator as recited in claim 3 wherein:

(a) said rod carries a piston slidably received in a fourth bore and (b) control pressure which is a function of the position of said spool in said sleeve is supplied to one face of said piston, thereby affecting the position of said rod in said third bore.

7. A proportional servo actuator as recited in claim 6 and further comprising a relief valve located in a fifth bore leading through said piston, whereby control pressure is vented through said fifth bore to tank when it exceeds a preset value.

8. In a proportional servo actuator comprising:

(a) a body containing a first bore;
(b) a sleeve containing a second bore slidably positioned in said first bore;
(c) a spool slidably positioned in said second bore;
(d) first means for biasing said sleeve in a first direction in said first bore;
(e) second means for biasing said spool in a second direction, opposite to the first direction, in said second bore;
(f) third means for moving said spool in the first direction against the bias of said second means; and
(g) fourth means for moving said sleeve in the second direction against the bias of said first means,
the improvement wherein said fourth means comprises:
(h) a control cam which
(i) has a cam surface positioned to contact said sleeve and
(ii) is mounted for pivotal movement about a pivotal axis perpendicular to the direction of motion of said sleeve;
(i) fifth means for biasing said control cam in a first angular direction about its pivotal axis; and
(j) sixth means for moving said control cam in a second angular direction, opposite to said first angular direction, about its pivotal axis,
whereby operation of said sixth means changes the relationship between the translational movement of said control cam and the motion of said sleeve in said first bore.

9. In a proportional servo actuator as recited in claim 8, the further improvement wherein:
(a) said control cam is mounted for translational movement in the direction perpendicular both to its pivotal axis and the direction of motion of said sleeve and
(b) the cam surface on said control cam is positioned such that
(i) translational movement of said control cam causes said sleeve to move in said first bore in a manner which is dependent on the angle of said control cam and
(ii) angular adjustment of said control cam changes the relationship between the translational movement of said control cam and the motion of said sleeve.

10. In a proportional servo actuator as recited in claim 9, the further improvement wherein:
(a) the proportional servo actuator further comprises a rod slidably received in a third bore;
(b) said control cam is pivotably mounted on said rod; and
(c) the position of said rod in said third bore is a function of the position of said spool in said sleeve.

11. In a proportional servo actuator as recited in claim 10, the further improvement wherein said sixth means is mounted on said rod.

12. In proportional servo actuator as recited in claim 11, the further improvement wherein said sixth means is a set screw threadedly received in said rod.

13. In a proportional servo actuator as recited in claim 9, the further improvement wherein:
(a) said rod carries a piston slidably received in a fourth bore and
(b) control pressure which is a function of the position of said spool in said sleeve is supplied to one face of said piston, thereby affecting the position of said rod in said third bore.

14. In a proportional servo actuator as recited in claim 13, the further improvement comprising a relief valve located in a fifth bore leading through said piston, whereby control pressure is vented through said fifth bore to tank when it exceeds a preset value.

15. A proportional servo actuator comprising:
(a) a body containing a first bore;
(b) a sleeve containing a second bore slidably positioned in said first bore;
(c) a spool slidably positioned in said second bore;
(d) first means for biasing said sleeve in a first direction in said first bore;
(e) second means for biasing said spool in a second direction, opposite to the first direction, in said second bore;
(f) third means for moving said spool in the first direction against the bias of said second means;
(g) fourth means for moving said sleeve in the second direction against the bias of said first means;
(h) a piston slidably received in a fourth bore;
(i) seventh means for supplying control pressure which is a function of the position of said spool in said sleeve to one face of said piston, thereby affecting the position of said piston in said fourth bore; and
(j) a relief valve located in a fifth bore leading through said piston,
whereby control pressure is vented through said fifth bore to tank when it exceeds a preset valve.

16. A proportional servo actuator as recited in claim 15 wherein said piston is operatively connected to said fourth means.

17. A proportional servo actuator as recited in claim 16 wherein said fourth means comprises:
(a) a control cam which
(i) has a cam surface positioned to contact said sleeve and
(ii) is mounted for pivotal movement about a pivotal axis perpendicular to the direction of motion of said sleeve;
(b) fifth means for biasing said control cam in a first angular direction about its pivotal axis; and
(c) sixth means for moving said control cam in a second angular direction, opposite to said first angular direction, about its pivotal axis,
whereby operation of said sixth means changes the relationship between the translational movement of said control cam and the motion of said sleeve in said first bore.

18. A proportional servo actuator as recited in claim 17 wherein:
(a) said control cam is mounted for translational movement in the direction perpendicular both to its pivotal axis and the direction of motion of said sleeve and
(b) the cam surface on said control cam is positioned such that
(i) translational movement of said control cam causes said sleeve to move in said first bore in a manner which is dependent on the angle of said control cam and
(ii) angular adjustment of said control cam changes the relationship between the translational movement of said control cam and the motion of said sleeve.

19. A proportional servo actuator as recited in claim 18 wherein:
(a) the proportional servo actuator further comprises a rod slidably received in a third bore;
(b) said control cam is pivotably mounted on said rod; and (c) the position of said rod in said third bore is a function of the position of said spool in said sleeve.

20. A proportional servo actuator as recited in claim 19 wherein said sixth means is mounted on said rod.

21. A proportional servo actuator as recited in claim 20 wherein said sixth means is a set screw threadedly received in said rod.

22. A proportional servo actuator as recited in claim 19 wherein said rod is operatively connected to said piston.

23. In a proportional servo actuator comprising:
(a) a body containing a first bore;
(b) a sleeve containing a second bore slidably positioned in said first bore;
(c) a spool slidably positioned in said second bore;
(d) first means for biasing said sleeve in a first direction in said first bore;
(e) second means for biasing said spool in a second direction, opposite to the first direction, in said second bore;
(f) third means for moving said spool in the first direction against the bias of said second means;
(g) fourth means for moving said sleeve in the second direction against the bias of said first means;
(h) a piston slidably received in a fourth bore; and
(i) seventh means for supplying control pressure which is a function of the position of said spool in said sleeve to one face of said piston, thereby affecting the position of said piston in said fourth bore,
the improvement comprising:
(j) a relief valve located in a fifth bore leading through said piston, whereby control pressure is vented through said fifth bore to tank when it exceeds a preset valve.

24. In a proportional zero actuator as recited in claim 23, the further improvement wherein said piston is operatively connected to said fourth means.

25. In a proportional servo actuator as recited in claim 24, the further improvement wherein said fourth means comprises:
(a) a control cam which
(i) has a cam surface positioned to contact said sleeve and
(ii) is mounted for pivotal movement about a pivotal axis perpendicular to the direction of motion of said sleeve;
(b) fifth means for biasing said control cam in a first angular direction about its pivotal axis; and
(c) sixth means for moving said control cam in a second angular direction, opposite to said first angular direction, about its pivotal axis,
whereby operation of aid sixth means changes the relationship between the translational movement of said control cam and the motion of said sleeve in said first bore.

26. In a proportional servo actuator as recited in claim 25, the further improvement wherein:
(a) said control cam is mounted for translational movement in the direction perpendicular both to its pivotal axis and the direction of motion of said sleeve and
(b) the cam surface on said control cam is positioned such that
(i) translational movement of said control cam causes said sleeve to move in said first bore in a manner which is dependent on the angle of said control cam and
(ii) angular adjustment of said control cam changes the relationship between the translational movement of said control cam and the motion of said sleeve.

27. In a proportional servo actuator as recited in claim 26, the further improvement wherein:
(a) the proportional servo actuator further comprises a rod slidably received in a third bore;
(b) said control cam is pivotably mounted on said rod; and
(c) the position of said rod in said third bore is a function of the position of said spool in said sleeve.

28. In a proportional servo actuator as recited in claim 27, the further improvement wherein said sixth means is mounted on said rod.

29. In a proportional servo actuator as recited in claim 28, the further improvement wherein said sixth means is a set screw threadedly received in said rod.

30. In a proportional servo actuator as recited in claim 29, the further improvement wherein said rod is operatively connected to said piston.

31. A tilting cam, rotating barrel pump comprising:
(a) a rotatable barrel containing pumping pistons;
(b) a tiltable pump can operatively connected to said rotatable barrel such that
(i) when said pump cam is perpendicular to the axis of said barrel, said pumping pistons are not displaced axially and no fluid is pumped and
(ii) the more said pump cam is tilted relative to the axis of said barrel, the more the pumping pistons are displaced axially and the more fluid is pumped; and
(c) a proportional servo actuator operatively connected to said pump cam to affect the angle between said pump cam and the axis of said barrel, said proportional servo actuator comprising:
(i) a body containing a first bore;
(ii) a sleeve containing a second bore slidably positioned in said first bore;
(iii) a spool slidably positioned in said second bore;
(iv) first means for biasing said sleeve in a first direction in said first bore;
(v) second means for biasing said spool in a second direction, opposite to the first direction, in said second bore;
(vi) third means for moving said spool in the first direction against the bias of said second means; and
(vii) fourth means for moving said sleeve in the second direction against the bias of said first means, said fourth means comprising:
[A] a cam which has a cam surface positioned to contact said sleeve and is mounted for pivotal movement about a pivotal axis perpendicular to the direction of motion of said sleeve;
[B] fifth means for biasing said control cam in a first angular direction about its pivotal axis; and
[C] sixth means for moving said control cam in a second angular direction, opposite to said first angular direction, about its pivotal axis,
whereby operation of said sixth means changes the relationship between the translational movement of said control cam and the motion of said sleeve in said first bore.

32. A tilting cam, rotating barrel pump is recited in claim 31 wherein:
(a) said control cam is mounted for translational movement in the direction perpendicular both to its pivotal axis and the direction of motion of said sleeve and
(b) the cam surface on said control cam is positioned such that (i) translational movement of said control cam causes said sleeve to move in said first bore in a manner which is dependent on the angle of said control cam and (ii) angular adjustment of said control cam changes the relationship between the translational movement of said control cam and the motion of said sleeve.

33. A tilting cam, rotating barrel pump as recited in claim 32 wherein:

(a) the proportional servo actuator further comprises a rod slidably received in a third bore;

(b) said control cam is pivotably mounted on said rod; and (c) the position of said rod in said third bore is a function of the position of said spool in said sleeve.

34. A tilting cam, rotating barrel pump as recited in claim 33 wherein said sixth means is mounted on said rod.

35. A tilting cam, rotating barrel pump as recited in claim 34 wherein said sixth means is a set screw threadedly received in said rod.

36. A tilting cam, rotating barrel pump as recited in claim 33 wherein:

(a) said rod carries a piston slidably received in a fourth bore and (b) control pressure which is a function of the position of said spool in said sleeve is supplied to one face of said piston, thereby affecting the position of said rod in said third bore.

37. A tilting cam, rotating barrel pump as recited in claim 36 and further comprising a pressure compensator control which destrokes the pump when a pre-set maximum system pressure has been reached.

38. A tilting cam, rotating barrel pump as recited in claim 37 wherein said pressure compensator control permits system pressure to act against said pump cam to bias said pump cam towards its null position when the pre-set maximum system pressure has been reached.

39. A tilting cam, rotating barrel pump as recited in claim 36 and further comprising a relief valve located in a fifth bore leading through said piston, whereby control pressure is vented through said fifth bore to tank when it exceeds a preset value.

40. In a tilting cam, rotating barrel pump comprising:

(a) a rotatable barrel containing pumping pistons;

(b) a tiltable pump cam operatively connected to said rotatable barrel such that (i) when said pump cam is perpendicular to the axis of said barrel, said pumping pistons are not displaced axially and no fluid is pump and (ii) the more said pump cam is tilted relative to the axis of said barrel, the more the pumping pistons are displaced axially and the more fluid is pumped; and (c) a proportional servo actuator operatively connected to said pump cam to affect the angle between said pump cam and the axis of said barrel, said proportional servo actuator comprising:

(i) a body containing a first bore;

(ii) a sleeve containing a second bore slidably positioned in said first bore;

(iii) a spool slidably positioned in said second bore;

(iv) first means for biasing said sleeve in a first direction in said first bore;

(v) second means for biasing said spool in a second direction, opposite to the first direction, in said second bore;

(vi) third means for moving said spool in the first direction against the bias of said second means; and (vii) fourth means for moving said sleeve in the second direction against the bias of said first means, the improvement wherein said fourth means comprises:

(h) a control cam which (i) has a cam surface positioned to contact said sleeve and (ii) is mounted for pivotal movement about a pivotal axis perpendicular to the director of motion of said sleeve;

(e) fifth means for biasing said control cam in a first angular direction about its pivotal axis; and (f) sixth means for moving said control cam in a second angular direction, opposite to said first angular direction, about its pivotal axis, whereby operation of said sixth means changes the relationship between the translational movement of said control cam and the motion of said sleeve in said first bore.

41. In a tilting cam rotating barrel pump as recited in claim 40, the further improvement wherein:

(a) said control cam is mounted for translational movement in the direction perpendicular both to its pivotal axis and the direction of motion of said sleeve and (b) the cam surface on said control cam is positioned such that (i) translational movement of said control cam causes said sleeve to move in said first bore in a manner which is dependent on the angle of said control cam and (ii) angular adjustment of said control cam changes the relationship between the translational movement of said control cam and the motion of said sleeve.

42. In a tilting cam, rotating barrel pump as recited in claim 41, the further improvement wherein:

(a) the proportional servo actuator further comprises a rod slidably received in a third bore;

(b) said control cam is pivotably mounted on said rod; and (c) the position of said rod in said third bore is a function of the position of said spool in said sleeve.

43. In a tilting cam, rotating barrel pump as recited in claim 42, the further improvement wherein said sixth means is mounted on said rod.

44. In a tilting cam, rotating barrel pump as recited in claim 43, the further improvement wherein said sixth means is a set screw threadedly received in said rod.

45. In a tilting cam, rotating barrel pump as recited in claim 41, the further improvement wherein:

(a) said rod carries a piston slidably received in a fourth bore and (b) control pressure which is a function of the position of said spool in said sleeve is supplied to one face of said piston, thereby affecting the position of said rod in said third bore.

46. A tilting cam, rotating barrel pump as recited in claim 45 and further comprising a pressure compensator control which destrokes the pump when a pre-set maximum system pressure has been reached.

47. A tilting cam, rotating barrel pump as recited in claim 46 wherein said pressure compensator control permits system pressure to act against said pump cam to bias said pump cam towards its null position when the pre-set maximum system pressure has been reached.

48. In a tilting cam, rotating barrel pump as recited in claim 45, the further improvement comprising a relief valve located in a fifth bore leading through said piston, whereby control pressure is vented through said fifth bore to tank when it exceeds a preset value.

49. A tilting cam, rotating barrel pump comprising:

(a) a rotatable barrel containing pumping pistons;

(b) a tiltable pump cam operatively connected to said rotatable barrel such that (i) when said pump cam is perpendicular to the axis of said barrel, said pumping pistons are not displaced axially and no fluid is pumped and (ii) the more said pump cam is tilted relative to the axis of said barrel, the more the pumping pistons are displayed axially and the more fluid is pumped; and (c) a proportional servo actuator operatively connected to said pump cam to affect the angle between said pump cam and the axis of said barrel, said proportional servo actuator comprising:

(i) a body comprising a first bore;

(ii) a sleeve containing a second bore slidably positioned in said first bore;

(iii) a spool slidably positioned in said second bore;

(iv) first means for biasing said sleeve in a first direction in said first bore;

(v) second means for biasing said spool in a second direction, opposite to the first direction, in said second bore;

(vi) third means for moving said spool in the first direction against the bias of said second means; and (vii) fourth means for moving said sleeve in the second direction against the bias of said first means;

(viii) a piston slidably received in a fourth bore;

(ix) seventh means for supplying control pressure which is a function of the position of said spool in said sleeve to one face of said piston, thereby affecting the position of said piston in said fourth bore; and (x) a relief valve located in a fifth bore leading through said piston, whereby control pressure is vented through said fifth bore to tank when it exceeds a preset valve.

50. A tilting cam, rotating barrel pump as recited in claim 49 wherein said piston is operatively connected to said fourth means.

51. A tilting cam, rotating barrel pump as recited in claim 50 wherein said fourth means comprises:

(a) a control cam which (i) has a cam surface positioned to contact said sleeve and (ii) is mounted for pivotal movement about a pivotal axis perpendicular to the direction of motion of said sleeve;

(b) fifth means for biasing said control cam in a first angular direction about its pivotal axis; and (c) sixth means for moving said control cam in a second angular direction, opposite to said first angular direction, about its pivotal axis, whereby operation of said sixth means changes the relationship between the translational movement of said control cam and the motion of said sleeve in said first bore.

52. A tilting cam, rotating barrel pump as recited in claim 51 wherein:

(a) said control cam is mounted for translational movement in the direction perpendicular both to its pivotal axis and the direction of motion of said sleeve and (b) the cam surface on said control cam is positioned such that (i) translational movement of said control cam causes said sleeve to move in said first bore in a manner which is dependent on the angle of said control cam and (ii) angular adjustment of said control cam changes the relationship between the translational movement of said control cam and the motion of said sleeve.

53. A tilting cam, rotating barrel pump as recited in claim 48 wherein:

(a) the proportional servo actuator further comprises a rod slidably received in a third bore;

(b) said control cam is pivotably mounted on said rod; and (c) the position of said rod in said third bore is a function of the position of said spool in said sleeve.

54. A tilting cam, rotating barrel pump as recited in claim 53 and further comprising a pressure compensator control which destrokes the pump when a pre-set maximum system pressure has been reached.

55. A tilting cam, rotating barrel pump as recited in claim 54 wherein said pressure compensator control permits system pressure to act against said pump cam to bias said pump cam towards its null position when the pre-set maximum system pressure has been reached.

56. A tilting cam, rotating barrel pump as recited in claim 53 wherein said sixth means is mounted on said rod.

57. A tilting cam, rotating barrel pump as recited in claim 56 wherein said sixth means is a set screw threadedly received in said rod.

58. A tilting cam, rotating barrel pump as recited in claim 53 wherein said rod is operatively connected to said piston.

59. In a tilting cam, rotating barrel pump comprising:

(a) a rotatable barrel containing pumping pistons;

(b) a tiltable pump cam operatively connected to said rotatable barrel such that (i) when said pump cam is perpendicular to the axis of said barrel, said pumping pistons are not displaced axially and no fluid is pumped and (ii) the more said pump cam is tilted relative to the axis of said barrel, the more the pumping pistons are displaced axially and the more fluid is pumped; and (c) a proportional servo actuator operatively connected to said pump cam to affect the angle between said pump cam and the axis of said barrel, said proportional servo actuator comprising:

(i) a body containing a first bore;

(ii) a sleeve containing a second bore slidably positioned in said first bore;

(iii) a spool slidably positioned in said second bore;

(iv) first means for biasing said sleeve in a first direction in said first bore;

(v) second means for biasing said spool in a second direction, opposite to the first direction, in said second bore;

(vi) third means for moving said spool in the first direction against the bias of said second means; and (vii) fourth means for moving said sleeve in the second direction against the bias of said first means;

(viii) a piston slidably received in a fourth bore; and (ix) seventh means for supplying control pressure which is a function of the position of said spool in said sleeve to one face of said piston, thereby affecting the position of said piston in said fourth bore, the improvement comprising a relief valve located in a fifth bore leading through said piston, whereby control pressure is vented through said fifth bore to tank when it exceeds a preset value.

60. In a tilting cam, rotating barrel pump as recited in claim 59, the further improvement wherein said piston is operatively connected to said fourth means.

61. In a tilting cam, rotating barrel pump as recited in claim 60, the further improvement wherein said fourth means comprises:

(a) a control cam which
  (i) has a cam surface positioned to contact said sleeve and
  (ii) is mounted for pivotal movement about a pivotal axis perpendicular to the direction of motion of said sleeve;
(b) fifth means for biasing said control cam in a first angular direction about its pivotal axis; and
(c) sixth means for moving said control cam in a second angular direction, opposite to said first angular direction, about its pivotal axis, whereby operation of said sixth means changes the relationship between the translational movement of said control cam and the motion of said sleeve in said first bore.

62. In a tilting cam, rotating barrel pump as recited in claim 61, the further improvement wherein:

(a) said control cam is mounted for translational movement in the direction perpendicular both to its pivotal axis and the direction of motion of said sleeve and
(b) the cam surface on said control cam is positioned such that
  (i) translational movement of said control cam causes said sleeve to move in said first bore in a manner which is dependent on the angle of said control cam and
  (ii) angular adjustment of said control cam changes the relationship between the translational movement of said control cam and the motion of said sleeve.

63. In a tilting cam, rotating barrel pump as recited in claim 62, the further improvement wherein:

(a) the proportional servo actuator further comprises a rod slidably received in a third bore;
(b) said control cam is pivotably mounted on said rod; and
(c) the position of said rod in said third bore is a function of the position of said spool in said sleeve.

64. In a tilting cam, rotating barrel pump as recited in claim 63, the further improvement wherein said sixth means is mounted on said rod.

65. In a tilting cam, rotating barrel pump as recited in claim 64, the further improvement wherein said sixth means is a set screw threadedly received in said rod.

66. In a tilting cam, rotating barrel pump as recited in claim 63, the further improvement wherein said rod is operatively connected to said piston.

* * * * *